US006848764B2

(12) United States Patent
Tang

(10) Patent No.: US 6,848,764 B2
(45) Date of Patent: Feb. 1, 2005

(54) METHOD AND APPARATUS FOR CONTROLLING HEATERS IN A CONTINUOUS INK JET PRINT HEAD

(75) Inventor: Manh Tang, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 147 days.

(21) Appl. No.: 10/121,401

(22) Filed: Apr. 12, 2002

(65) Prior Publication Data

US 2003/0193537 A1 Oct. 16, 2003

(51) Int. Cl.[7] ..... B41J 29/38
(52) U.S. Cl. ..... 347/10; 347/11
(58) Field of Search ..... 347/10, 48, 82

(56) References Cited

U.S. PATENT DOCUMENTS

| | | | | |
|---|---|---|---|---|
| 4,621,271 A | | 11/1986 | Brownstein | 347/211 |
| 4,951,152 A | | 8/1990 | Suzuki et al. | 358/298 |
| 4,994,822 A | | 2/1991 | Caine | 347/209 |
| 5,321,427 A | | 6/1994 | Agar et al. | 347/183 |
| 6,079,821 A | | 6/2000 | Chwalek et al. | 347/82 |
| 6,254,225 B1 | | 7/2001 | Chwalek et al. | 347/82 |
| 6,331,039 B1 | * | 12/2001 | Iwasaki et al. | 347/11 |

* cited by examiner

*Primary Examiner*—Stephen Meier
*Assistant Examiner*—Alfred Dudding
(74) *Attorney, Agent, or Firm*—William R Zimmerli

(57) ABSTRACT

A method for generating an electrical signal with a plurality of pulses used to operate a continuous inkjet printer having plurality of nozzles, including the steps of generating a data table with a plurality of segment values, each segment value designating one of a high pulse and a low pulse of the electrical signal, and designating the pulse width of the designated pulse, reading a segment value from the data table, and generating at least one of a high pulse and a low pulse, the generated pulse and pulse width of the generated pulse being designated by the read segment value. In addition, a control circuit for implementing the method includes a memory device adapted to store a data table with a plurality of segment values, a counter for sequentially counting based on a segment value from the data table, and a synchronization device.

31 Claims, 8 Drawing Sheets

METHOD AND APPARATUS FOR CONTROLLING HEATERS IN A CONTINUOUS INK JET PRINT HEAD

FIELD OF THE INVENTION

The present invention relates to a method and apparatus for operating heaters of a print head in a continuous ink jet to provide a stream of ink droplets. In particular, the present invention relates to a method and apparatus for generating a pulsetrain to operate the heaters of the print head to allow variation in pulse width and/or pulse period.

BACKGROUND OF THE INVENTION

Ink jet printing has become recognized as a prominent contender in the digitally controlled, electronic printing arena because of various advantages such as its non-impact, low noise characteristics and system simplicity. For these reasons, ink jet printers have achieved commercial success for home and office use and other areas.

Traditionally, color ink jet printing is accomplished by one of two technologies, referred to as drop-on-demand and continuous stream printing. Both technologies require independent ink supplies for each of the colors of ink provided. Ink is fed through channels formed in the print head. Each channel includes a nozzle from which droplets of ink are selectively extruded and deposited upon a medium. Each technology requires separate ink delivery systems for each ink color used in printing. Ordinarily, the three primary subtractive colors, i.e. cyan, yellow and magenta, are used because these colors can produce up to several million perceived color combinations.

In drop-on-demand ink jet printing, ink droplets are generated for impact upon a print medium using a pressurization actuator (thermal, piezoelectric, etc.). Selective activation of the actuator causes the formation and ejection of an ink droplet that crosses the space between the print head and the print medium and strikes the print medium. The formation of printed images is achieved by controlling the individual formation of ink droplets as the medium is moved relative to the print head.

In continuous stream or continuous ink jet printing, a pressurized ink source is used for producing a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or discarded. When printing is desired, the ink droplets are not deflected and allowed to strike a recording medium. Alternatively, deflected ink droplets may be allowed to strike the recording medium, while non-deflected ink droplets are collected in the ink capturing mechanism. While such continuous ink jet printing devices are faster than drop on demand devices and produce higher quality printed images and graphics, the electrostatic deflection mechanism they employ is expensive to manufacture and relatively fragile during operation.

Recently, a novel continuous ink jet printer system has been developed which renders the above-described electrostatic charging devices unnecessary and provides improved control of droplet formation. The system is disclosed in the commonly assigned U.S. Pat. No. 6,079,821 in which periodic application of weak heat pulses to the ink stream by a heater causes the ink stream to break up into a plurality of droplets synchronous with the applied heat pulses and at a position spaced from the nozzle. The droplets are deflected by heat pulses from a heater in a nozzle bore. This is referred to as asymmetrical application of heat pulses. The heat pulses deflect ink drops between a "print" direction (onto a recording medium), and a "non-print" direction (back into a "catcher").

While such continuous ink jet printers utilizing asymmetrical application of heat have demonstrated many proven advantages over conventional ink jet printers utilizing electrostatic charging tunnels, a cost effective and reliable method and apparatus for controlling the heaters of the ink jet printer is required to ensure proper operation of the ink jet printer. Otherwise, misdirection of the ink droplets may occur which will detriment the print quality.

SUMMARY OF THE INVENTION

In view of the foregoing, an advantage of the present invention is in providing a cost effective and reliable method and apparatus for controlling the heaters of the ink jet printer.

Another advantage of the present invention is in providing such a method and apparatus that allows generation of a signal usable for controlling the heaters where the pulse width and/or pulse period of the signal pulses are readily adjustable.

In accordance with one aspect of the present invention, the above noted advantages are attained by a method for generating an electrical signal with a plurality of pulses used to operate a continuous ink jet printer having plurality of nozzles, including the steps of generating a data table with a plurality of segment values, each segment value designating one of a high pulse and a low pulse of the electrical signal, and designating the pulse width of the designated pulse, reading a segment value from the data table, and generating at least one of a high pulse and a low pulse, the generated pulse and pulse width of the generated pulse being designated by the read segment value.

In one embodiment, the present method further includes the step of iteratively reading each of the plurality of segment values from the data table and the step of generating at least one of a high pulse and a low pulse after each segment value is read from the data table, the generated pulse and pulse width being designated by each of the iteratively read segment values. Because each of the segment values can be customized, pulse width of two consecutive high pulses or low pulses may be different from one another.

In another embodiment, the method further includes the step of loading a new plurality of segment values into the data table after the plurality of segment values are iteratively read from the data table. The method may further include the step of converting pulse width designated by each of the iteratively read segment values into time. In addition, the method may further include the step of iteratively designating which segment value is to be read.

In accordance with another embodiment of the present method, the plurality of segment values in the data table designate the high pulse and low pulse in alternating order. In addition, two segment values of the data table that designate two consecutive high or low pulses designate pulses having different pulse widths from one another. The low pulses may be used to delay the generation of the high pulses.

In yet another embodiment of the present method, the number of at least one of the high pulses and the low pulses in the data table is less than the maximum number of graytones of the continuous ink jet printer. The first segment value in the data table designates a high pulse or a low pulse which delays the generation of a first high pulse.

In accordance with another aspect of the present invention, the above noted advantages are attained by a control circuit for generating an electrical signal with a plurality of pulses used to operate a continuous ink jet printer having plurality of nozzles including a memory device adapted to store a data table with a plurality of segment values, each segment value designating one of a high pulse and a low pulse of the electrical signal, and designating the pulse width of the designated pulse, a counter for sequentially counting based on a segment value from the data table to thereby convert the pulse width designated by the segment value into time, and a synchronization device adapted to synchronize the memory device with the counter to allow loading of each of the plurality of segment values from the memory device to the counter.

In accordance with one embodiment, the counter provides a counter output to the synchronization logic and the synchronization logic outputs the electrical signal based on the counter output. In this regard, the synchronization logic may include a state machine and a read address generator that iteratively designates which segment value from the memory device is loaded to the counter by the synchronization device. In various embodiments of the control circuit, the memory device may be a random access memory and the counter may be a count down or a count up counter.

These and other advantages and features of the present invention will become more apparent from the following detailed description of the preferred embodiments of the present invention when viewed in conjunction with the accompanying drawings.

DETAILED DESCRIPTION OF THE INVENTION

As will be evident from the discussion below, the present invention provides an effective method for controlling the heaters of a print head in a continuous ink jet printer. In this regard, it should initially be noted that whereas the method as applied to a specific example is described, the present invention is not limited thereto but may be applied to other embodiments where the configuration of the printer, print head and/or heaters is different than that shown in the various figures.

Figure 1:
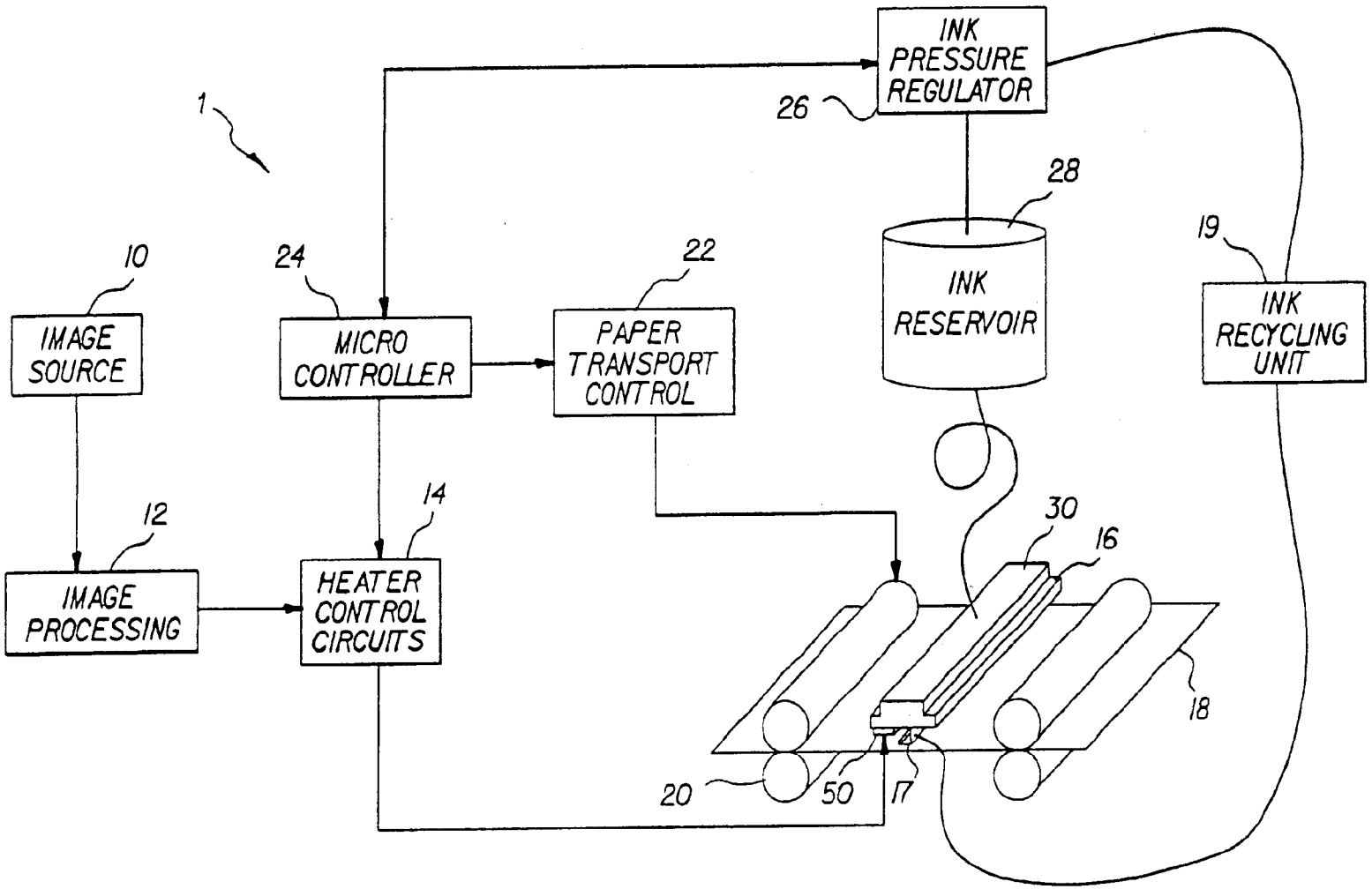
FIG. 1 is a schematic block diagram of an asymmetric heat-type continuous ink jet printing apparatus capable of implementing the method of the present invention.

FIG. 1 is a schematic block diagram of an asymmetric heat-type continuous ink jet printer system 1 capable of implementing the method of the present invention. The printer system 1 includes an image source 10 such as a scanner or computer which provides raster image data, outline image data in the form of a page description language, or other forms of digital image data. This image data is processed by an image processing unit 12 which also stores the image data in a memory (not shown). In this regard, the image processing unit 12 may perform various image enhancing algorithms, color correction to match the output devices, etc. A heater control circuit 14 which is controlled in the present embodiment by the microcontroller 24 reads data from the image memory and applies electrical pulses to a heater 50 that applies heat to a nozzle that is part of a print head 16. These pulses are applied at an appropriate time, and to the appropriate nozzle as described in further detail below, so that drops formed from a continuous ink jet stream will print spots on a recording medium 18 in the appropriate position designated by the data in the image memory and in the appropriate darkness or pixel graytone value.

Recording medium 18 is moved relative to print head 16 by a recording medium transport system 20 which is electronically controlled by a recording medium transport control system 22 which in turn, is controlled by a microcontroller 24. The recording medium transport system is shown in FIG. 1 as a schematic only, and many different mechanical configurations are possible in various embodiments. For example, a transfer roller could be used as recording medium transport system 20 to facilitate transfer of the ink drops to recording medium 18. Such transfer roller technology is well known in the art. In the case of page width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is preferably contained in an ink reservoir 28 under pressure. In the nonprinting state, continuous ink jet drop streams are unable to reach recording medium 18 due to an ink gutter 17 that blocks the ink jet drop stream and which may be operated to allow a portion of the ink to be recycled by an ink recycling unit 19. The ink recycling unit 19 reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface where a plurality of nozzles and heaters are situated. Of course, with print head 16 fabricated from silicon, it is possible to integrate heater control circuits 14 with the print head. The mechanics of the generation and deflection of ink droplets of the ink stream is presented in U.S. Pat. No. 6,079,821 described previously and thus, further detail is omitted here. The print head 16 is controlled by the heater control circuits 14 which are operated by the micro-controller 24 in accordance with the present invention discussed below which provide an effective method for controlling the heaters of print head 16.

Figure 2:
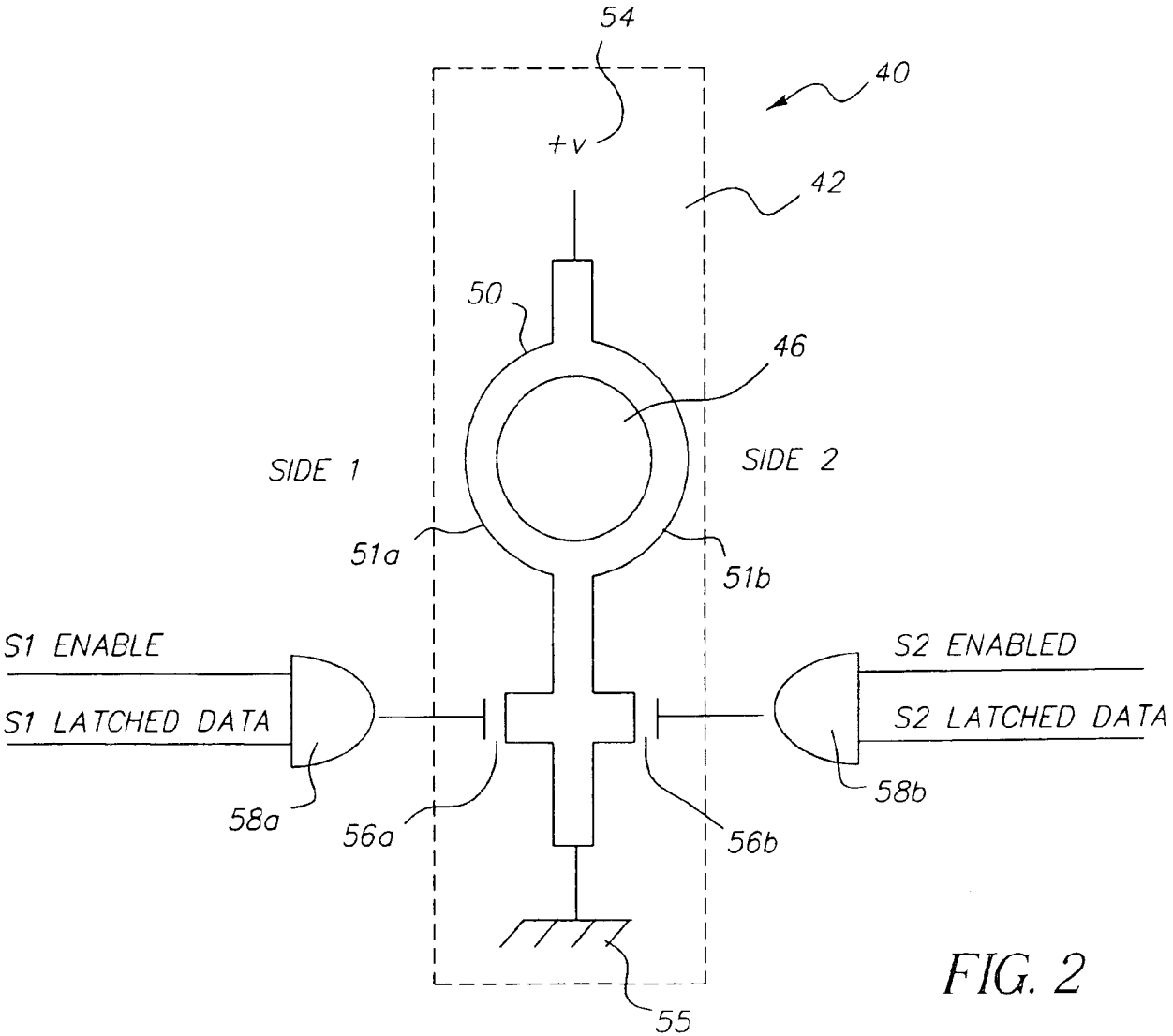
FIG. 2 is a schematic diagram of an exemplary embodiment of a nozzle provided on the print head.

FIG. 2 is a schematic diagram of an exemplary embodiment of one nozzle 40 with a nozzle bore 46 provided on the print head 16 with a heater 50 substantially encircling the nozzle bore 46. Of course, the print head 16 may be provided with a plurality of such nozzles and corresponding heaters as well. The heater 50 in the illustrated example has a pair of opposing semicircular elements covering almost all of the nozzle perimeter. In particular, the heater 50 has a first heater element 51*a* positioned on SIDE 1 in the present figure which is operable to deflect the ink droplets so that they impinge on the recording medium 18 or are captured by the gutter 17 shown in FIG. 1. The heater 50 further includes a second heater element 51*b* positioned on SIDE 2 which is operable by a deflection correcting electric pulse which may be used to prevent ink droplets generated after the end of a printing operation from erroneously striking the recording medium 18.

Of course, in other embodiments, the heater elements may be of any appropriate shape and may have only one heater element which is operated by the control circuit 14 to generate and deflect the ink droplets. However, by providing a second heater element on an opposing side as shown in the present example, a deflection correcting electrical pulse may be provided to the second heater element to correct the deflection of the ink droplet at the end of the print operation to further minimize potential ink droplet misdirection. The details of such operation is provided in U.S. Pat. No. 6,254,225 to Chwalek et al. and need not be present herein.

As can be seen, the first and second heater elements 51*a* and 51*b* respectively are connected to a power source 54 and ground 55, the power for the first heater element 51*a* and the second heater element 51*b* being turned on and off by driver transistors 56*a* and 56*b* respectively. The driver transistors 56*a* and 56*b* are engaged by a signal from AND gates 58*a* and 58*b* respectively, such signal being provided by each of the AND gates when the "ENABLE" and "LATCHED DATA" signals for the corresponding AND gate is received. When the driver transistors 56*a* or 56*b* are engaged, the respective heater element is activated to cause deflection of the ink droplet, again, the heater element 51*b* being timed by a deflection correcting electrical pulse. Again, in other embodiments, only SIDE 1 having the first heater element 51*a* may be provided which is operated by the control circuit 14 in the manner described below to generate and deflect the ink droplets.

Electrical pulses or pulsetrains from the control circuit 14 is provided to the first heater element 51*a* so that the asymmetric application of heat generated on SIDE 1 of the nozzle bore 46 to periodically deflect the ink droplet stream during a printing operation by the heater section 51*a*. Control circuit 14 may be programmed to supply power to the first heater element 51*a* of the heater 50 in the form of pulses described in detail below, deflection of an ink droplet occurring whenever an electrical power pulse by the AND gate 58*a* is provided. In one embodiment, the deflected ink droplets reach the recording medium 18 while the undeflected drops may be blocked from reaching recording medium 18 by a cut-off device such as the ink gutter 17 noted above. In an alternate printing scheme, ink gutter 17 may be placed to block deflected drops so that undeflected drops will be allowed to reach recording medium 18.

The heater elements 51*a* and 51*b* of heater 50 may be made of doped polysilicon, although other resistive heater materials could be used. Heater 50 is separated from substrate 42 by thermal and electrical insulating layer (not shown) and the nozzle bore 46 may be etched. The surface of the print head 16 can be coated with a hydro-phobizing layer (not shown) to prevent accidental spread of the ink across the front of the print head 16.

Figure 3:
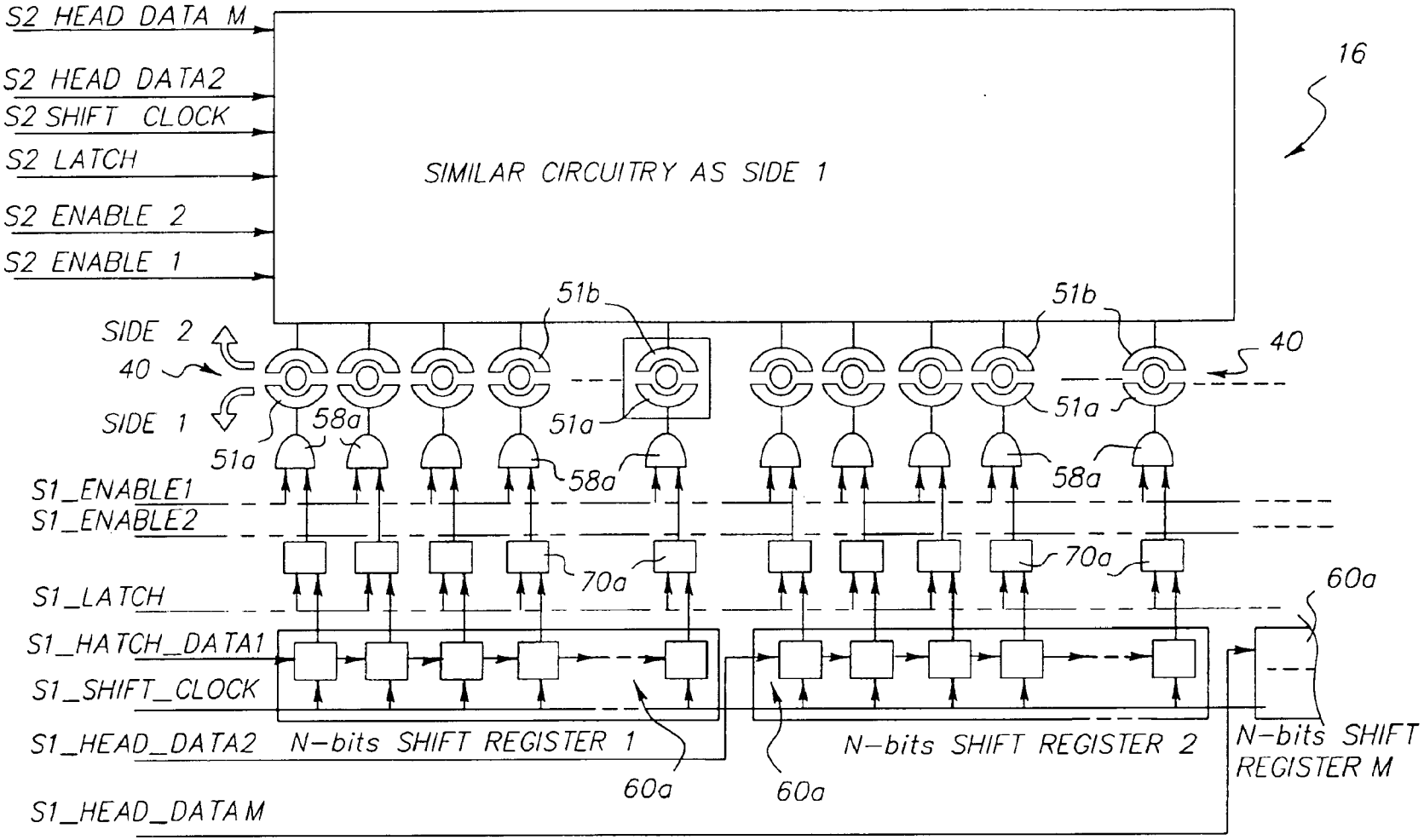
FIG. 3 is a schematic diagram of one configuration of a print head in accordance with one embodiment having a plurality of nozzles showing the circuitry of SIDE 1.

The operation of the first heater elements 51*a* of the heater 50 on the print head 16 which are actuated to deflect the ink droplets is described herein below so that fuller appreciation of the operation of the second heater elements 51*b* in accordance with the present invention as discussed later may be attained. In this regard, FIG. 3 shows one example configuration of a print head 16 with plurality of nozzles 40 having the first heater elements 51*a* and second heater elements 51*b*. As can be appreciated, only representative elements have been enumerated to simplify the figure and the specific components and the signals received are referred to directly. In this regard, FIG. 3 shows the details of SIDE 1 which is operable to control the first heater elements 51*a* of the nozzles 40 to deflect the ink droplets so that they impinge on the recording medium 18 or are captured by the gutter 17 shown in FIG. 1. Moreover, as indicated in FIG. 3, the details of SIDE 2 which is operable to control the second heater elements 51*b* to prevent ink droplets generated after the end of a printing operation from erroneously striking the recording medium 18, is substantially similar to the details of SIDE 1. However, it should be appreciated that SIDE 2 may be operated in a manner similar to SIDE 1.

To control the large number of heaters, the ink jet print head 16 further includes plurality of electronic serial shift registers 60*a* on SIDE 1 and serial shift registers on SIDE 2 (not shown), in this case, M serial shift registers per side, to minimize the number of electrical connections between the heater control circuit 14 and the print head 16. Each serial shift register may be 1-bit wide by N-bits long as shown in FIG. 3. Thus, N×M is the total number of heaters per side (SIDE 1 and SIDE 2) in the print head 16. In this regard, in FIG. 3, S1 and S2 prefixes are used for the various signals to indicate SIDE 1 or SIDE 2 respectively but is generally omitted since both of these sides are provided with similar signals and only SIDE 1 is discussed in detail relative to FIG. 3. In addition, the signals are also designated with suffixes 1 or 2 if it aids in clarifying the particular signal in FIG. 3.

The SHIFT_CLOCK signal is used to move the digital data value of 1 or 0 present at the HEAD_DATA1 and HEAD_DATA2 signals through the SHIFT REGISTER 1 and SHIFT REGISTER 2 respectively. One bit of data is shifted for each clock pulse per shift register. The serial shift registers are analogous to a bucket brigade, where the contents of a register location (for instance at P) is moved into a subsequent register location (P+1) on the rising edge or other portion of the clock signal. The contents of register location (P−1) is moved into location (P) on this same clock signal. Thus, to fill all N locations of SHIFT REGISTER 1 and SHIFT REGISTER 2 with new data from the HEAD_DATA1 and HEAD_DATA2 signal requires N clock periods in the illustrated embodiment.

In addition to the serial shift registers shown in FIG. 3, the print head 16 contains a separate set of latch registers 70*a*, and as shown, each of the bits in the serial shift registers having an associated latch register 70*a*. Therefore, in the illustrated embodiment, there are N×M latch registers 70*a*. The operation of the latch registers 70*a* is controlled by the LATCH signal. During normal operation of the print head 16, the latch registers 70*a* hold a set of constant data values for the first heater elements 51*a* while a new set of data is being clocked into the serial shift registers 60*a*. When the serial shift registers 60*a* have been filled with N new data values, the LATCH signal pulses high. The high pulse on the LATCH signal transfers the contents of all M serial shift registers 60*a* into their associated latch registers 70*a*. The contents of the latch registers 70*a* and their associated outputs remain constant until the next LATCH pulse occurs.

As shown in FIGS. 2 and 3, the output of each latch register 70*a* is connected to an associated digital AND gate 58*a* which was described above relative to FIG. 2. The output of each AND gate 58*a* is connected to an associated driver transistor 56*a* also described above which is used to apply power to the first heater element 51*a* associated with each nozzle 40. The driver transistor 56*a*, for example, could be an open collector NPN transistor or an open drain N-channel power MOSFET device as shown in FIG. 2, which acts as a simple electrically controlled ON/OFF switch for the first heater element 51*a*.

A second signal, generically referred to as ENABLEx, and in the present example, the ENABLE1 and ENABLE2 signal, is connected in common to the AND gates 58*a* within each heater group. In this regard, in simple print head configurations, there may be just one heater group where all heaters are connected to one ENABLE signal for the whole print head. In other configurations, especially for larger nozzle count such as the embodiment shown in FIG. 3, the print head 16 may be divided into several heater groups, each group having its own ENABLEx signal such as the ENABLE1 and ENABLE2 signals shown for the present illustrated example. One reason why the heaters are divided into heater groups is to minimize power supply requirements since each heater group can be selectively energized in succession. This would avoid the need to energize all the heaters on the print head at the same time which would increase power supply requirements.

Thus, as previously described, for an individual first heater element 51*a* to be energized to heat one side of the nozzle 40, two conditions must be true in the present embodiment:

(1) The contents of the associated latch register must be a digital 1; and (2) The ENABLEx signal for the heater group that the first heater element is part of must be a digital 1.

When both signals to the AND gate 58*a* are digital 1, the output of the AND gate 58*a* is a digital 1 so that the associated driver transistor 56*a* is turned ON and power is applied to the first heater element 51*a*. In accordance with the illustrated embodiment, the ENABLEx signal defines the ON time for any first heater element 51*a*, and the output of the associated latch register 70*a* controls whether a heater is ON or OFF during a particular printing operation so that the appropriate graytone level L of the continuous G graytones can be attained. In this regard, it should be noted that the maximum number of graytones is referred to herein as G graytones whereas the actual graytone level of a given particular pixel is referred to herein as graytone level L. Thus, in the examples discussed herein below, maximum of 8 graytones are possible (G=8), the graytone levels L being 0, 1, 2 . . . 6, 7. It should be noted that 0 is considered as one of the graytone levels since it represents minimum print density (i.e. no ink) and graytone level 7 is the darkest graytone level. Of course, in other examples, different number of graytone levels are possible as well.

Figure 4:
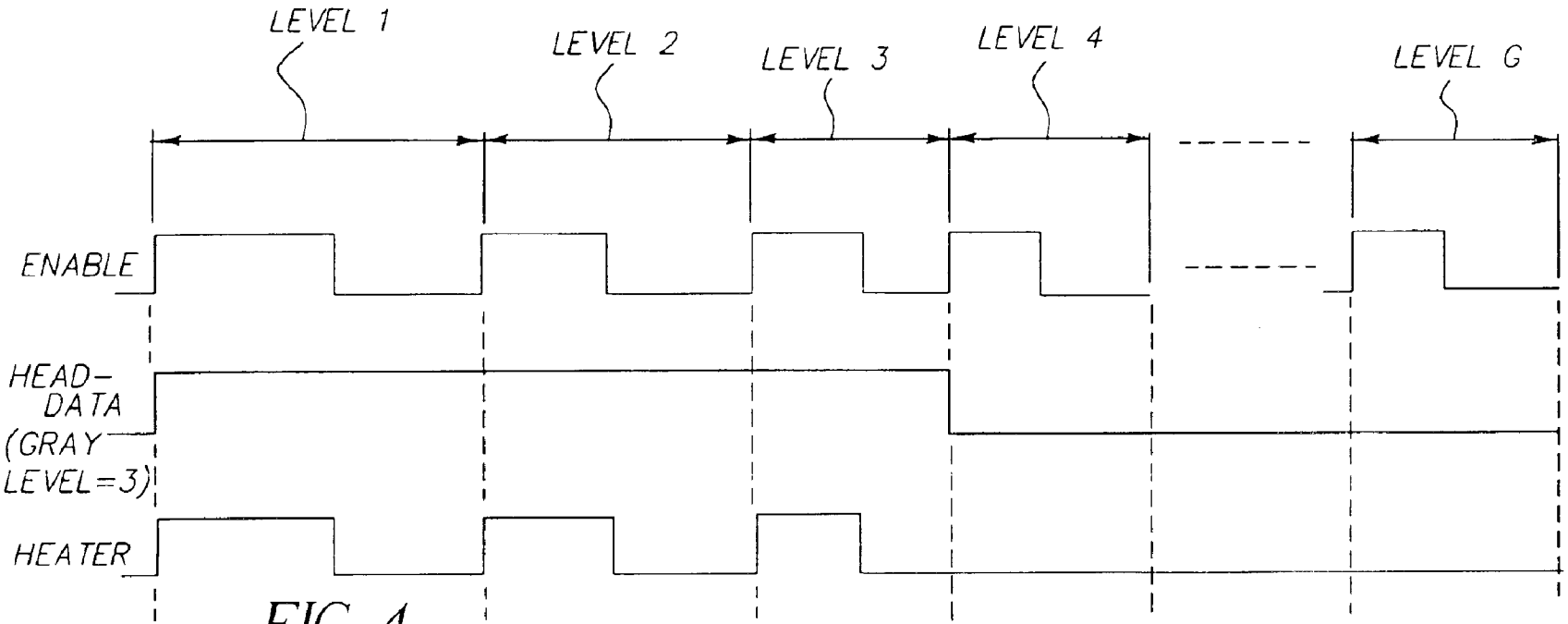
FIG. 4 is a schematic illustration of the ENABLE and HEAD_DATA signals which are combined to provided the HEATER_DATA in accordance with one embodiment of the present invention.

FIG. 4 shows an example of an electrical pulse train provided to the first heater elements 51*a* on SIDE 1 of one of the nozzles 40 of the continuous tone ink jet printer system 1 capable of printing pixels having up to the maximum G graytones, present embodiment showing a pulse train which will print a pixel with a graytone level of 3. As can be seen by viewing FIGS. 3 and 4 together, FIG. 4 illustrates the ENABLE signals provided to the AND gates 58*a*, and HEAD_DATA signals which are provide to the shift registers 60*a*, the HEAD_DATA being correlated to the image data value which is indicative of the graytone level L of the image to be printed.

The ENABLE signal is pulsed G-1 times, the ENABLE signal not being pulsed when graytone level is 0 which signifies the minimum density when no printing occurs. In the illustrated example of FIG. 4, the HEAD_DATA that is to be shifted in to the shift register 60*a* for a particular first heater element 51*a* consists of three digital values of 1 and the remainder being 0. When the shifted HEAD_DATA is a digital 1, the first heater element 51*a* is pulsed ON for the time duration which is controlled by the ENABLE signal for that particular graytone level. When the shifted HEAD_DATA is a digital 0, the heater is OFF regardless the state of the ENABLE signal. Therefore, the ENABLE signal establishes the maximum number of times any first heater element 51*a* can be pulsed ON, which in the present embodiment, is the maximum graytone level L that can be printed. The HEAD_DATA shifted into the serial shift register 60*a* controls the number of times a particular heater will be pulsed ON to produce the desired graytone level in the printed image. Thus, in this example, since the HEAD_DATA signal is provided for graytone levels 1, 2, and 3, the corresponding first heater element 51*a* is actuated by the HEATER_DATA pulse train as shown which is provided by the corresponding AND gate 58*a* and is derived from the ENABLE signal and the HEAD_DATA signal.

Stated in another manner, whereas the ENABLE signal establishes the timing of the operation of the first heater element 51*a* up to its maximum graytone level, the HEAD_DATA signal determines the actual number of the operation of the first heater element 51*a* since it is correlated to the image data value. Correspondingly, both of these signals are used to generate the HEATER_DATA pulse train as shown which is used to actuate the first heater element 51*a* to deflect the continuous ink jet droplets.

The HEAD_DATA signal may be generated in any appropriate manner to practice the present invention as described above. Thus, the details of generating the HEAD_DATA signal is omitted herein. However, one method of generating the HEAD_DATA signal for both the first heater element 51*a* and second heater element 51*b* are discussed in detail in pending U.S. patent application Ser. No. 10/172,429, entiled METHOD OF CONTROLLING HEATERS IN A CONTINUOUS INK JET PRINT HEAD HAVING SEGMENTED HEATERS TO PREVENT TERMINAL INK DROP MISDIRECTION commonly assigned to the assignee of the present application, which is incorporated herein by reference.

Figure 5:
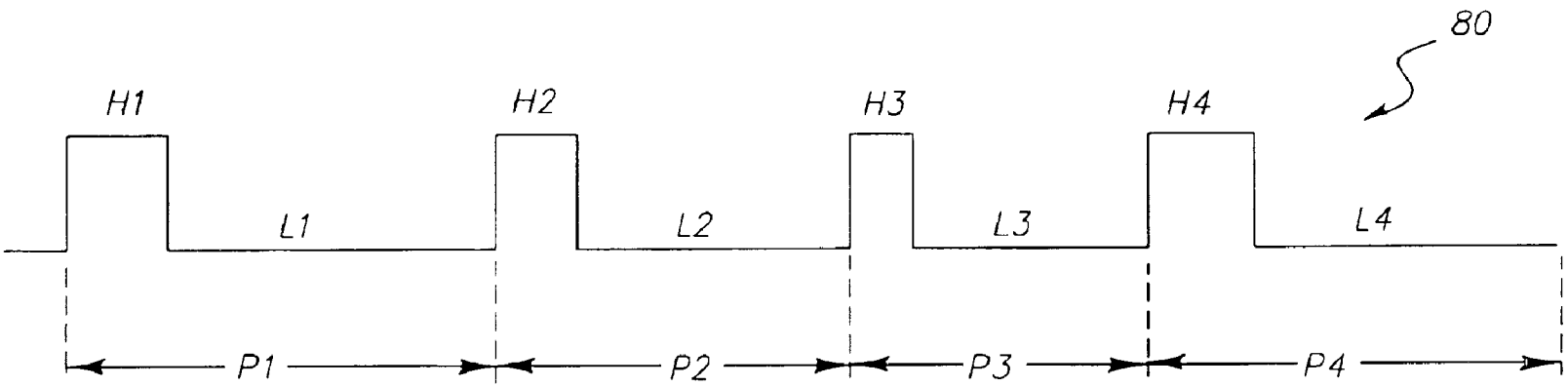
FIG. 5 is a schematic illustration of a generic ENABLE signal used to allow actuation of a nozzle in a print head.

A generic form of the ENABLE signal waveform/pulsetrain 80 which is used in the manner above described is shown in FIG. 5, only four sample pulses being provided in the pulsetrain 80. In this regard, the present method provides a simple method for generating the ENABLE signal having a variable pulse width and/or variable pulse period waveform for use in controlling the heaters 51*a* of inkjet print head 16, the method being implemented preferably via the control circuits 14 as detailed below. Of course, in other embodiments, the present method may be implemented by the micro-controller 24 or directly on the print head 16 itself.

Referring again to FIG. 5, it should be noted that:

P=Pulse period=H+L

H=High Pulse Width

L=Low Pulse Width

It should also be noted that the numeral following the pulse indicator signifies the graytone level to which the generated pulse corresponds, the numeral generically being referred to herein as "x". Thus, P1 refers to the pulse period corresponding to graytone level 1 whereas Px refers to pulse period in general.

In accordance with the present invention, Hx and Lx can take on any values thereby providing variable pulse width and/or variable pulse period so that the pulsetrain 80 can be totally customized to the particular application and/or print head. Thus, the present invention provides a method for generating the ENABLE signal where each pulse corresponding to each gray level can be adjusted independently and dynamically from one another.

As shown in FIG. 5, the ENABLE signal represented by the pulsetrain 80 can be divided into pairs of HIGH and LOW pulse width segments Hx and Lx, respectively. Each pair of pulse width segments forms one of the discrete variable time periods for graytone level 1 to graytone level G-1 of a G graytone level printing system.

The HIGH pulse width segment of each pulse period is the "ON" time of the heater for that particular gray level and may be a digital 1 signal. In other words, the HIGH pulse width segment may be the power pulse utilized to operate a designated heater. In the present example, the pulsetrain 80 is the ENABLE signal provided to an AND gate 58*a* such that when the HIGH pulse width is provided, the corresponding first heater element 51*a* is operated when the HEAD_DATA signal is also provided to the AND gate 58*a*. Of course, in other embodiments, the heater element may be operated directly by the ENABLE signal itself.

In accordance with the example of the present method, the ENABLE signal, i.e. the pulsetrain 80, may be represented in a tabular form in an ENABLE Table having the segment values as listed in Table 1 below. As can be seen, the ENABLE Table designate the high pulse and low pulse in alternating order in the illustrated example. Of course, the actual segment values would be numerically represented instead of the descriptors which are shown below for clarity. The actual numerical values may be calculated in various manners, one of which is further detailed below.

TABLE 1

| |
|---|
| HIGH segment pulse width 1 |
| LOW segment pulse width 1 |
| HIGH segment pulse width 2 |
| LOW segment pulse width 2 |
| HIGH segment pulse width 3 |
| LOW segment pulse width 3 |

TABLE 1-continued

| |
|---|
| . |
| . |
| . |
| HIGH segment pulse width L |
| LOW segment pulse width L |

Figure 6:
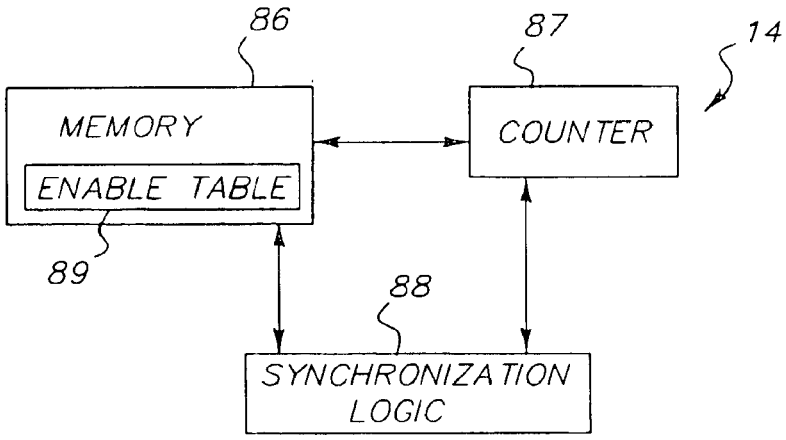
FIG. 6 is a high level schematic diagram of the heater control circuit shown in FIG. 1.

FIG. 6 shows a high level block diagram of the heater control circuit 14 shown in FIG. 1 in accordance with one embodiment which may be used to implement the method of the present invention. However, as previously noted, the present method may be implemented via the micro-controller 24 or directly on the print head 16 itself.

The control circuit 14 is designed to convert the values of TABLE 1 in the ENABLE Table 89, into the appropriate ENABLE signal pulsetrain which is used to allow actuation of a designated heater element in the manner previously described. As can be seen, the control circuit includes memory 86 where the ENABLE Table 89 and the contents thereof are stored, a counter 87 which converts the information in the ENABLE Table into time by counting for the pulse width designated by the segment values of the ENABLE Table, and a synchronization logic 88 that controls the memory 86 and the counter 87 to allow loading of each of the plurality of segment values from the memory device 86 to the counter 87. In the present embodiment, the synchronization logic 88 also generates the ENABLE signal pulsetrain generically shown in FIG. 5 as its output based on the output of the counter 87.

Figure 7:
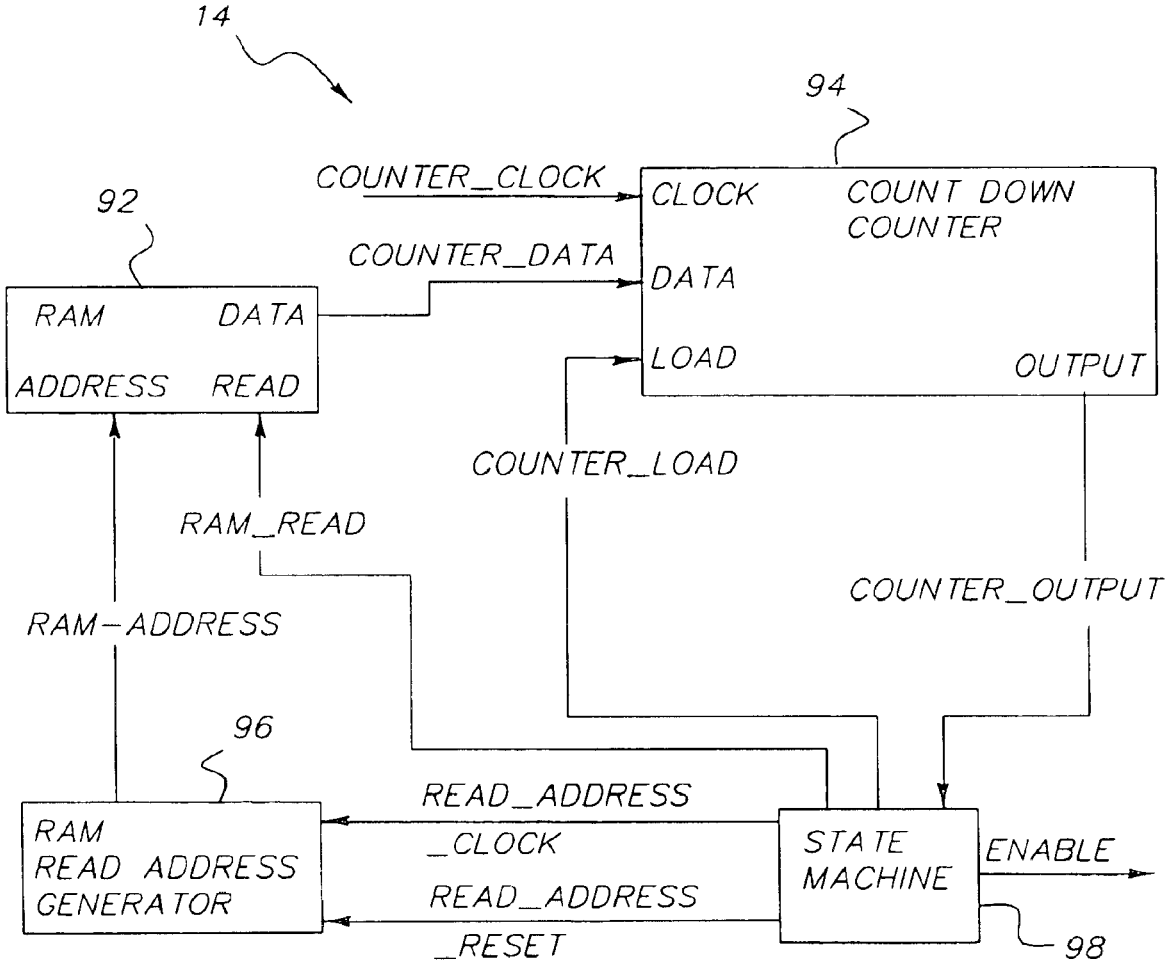
FIG. 7 is a schematic diagram of one embodiment of the control circuit of FIG. 6.

One embodiment for implementing the control circuit 14 of FIG. 6 is shown in detail in FIG. 7. In the illustrated embodiment, the memory 86 is implemented using random access memory (RAM) 92, while the counter 87 is implemented using a Loadable Count Down Counter 94. The synchronization logic 88 is implemented using various subcomponents including the RAM Read Address Generator 96 that iteratively designates which segment value is loaded to the Count Down Counter 94 from the RAM 92 by the State Machine 98. It is noted that in the present embodiment, the RAM Read Address Generator 96 is a count-up counter generally known in the control logic art. In addition, it is further noted that state machines such as the State Machine 98 utilized in the present embodiment are also commonly used in designing control logic. Therefore, the details of these components are omitted herein.

These components of the control circuit 14 are utilized to execute a sequence of operations over time, based on the ENABLE Table 89 and various inputs to generate the desired pulsetrain to thereby allow actuation of the heater elements as described. Of course, it should be noted that FIG. 7 shows only one specific implementation of the control circuit 14 shown in FIG. 6 and there are many other ways that one can implement the control circuit 14 using different electrical components. For instance, a count-up counter may be used instead of the count down counter 94 and the synchronization logic 88 can be implemented by other devices or methods instead of the method using the state machine 98 shown in FIG. 7.

Figure 8:
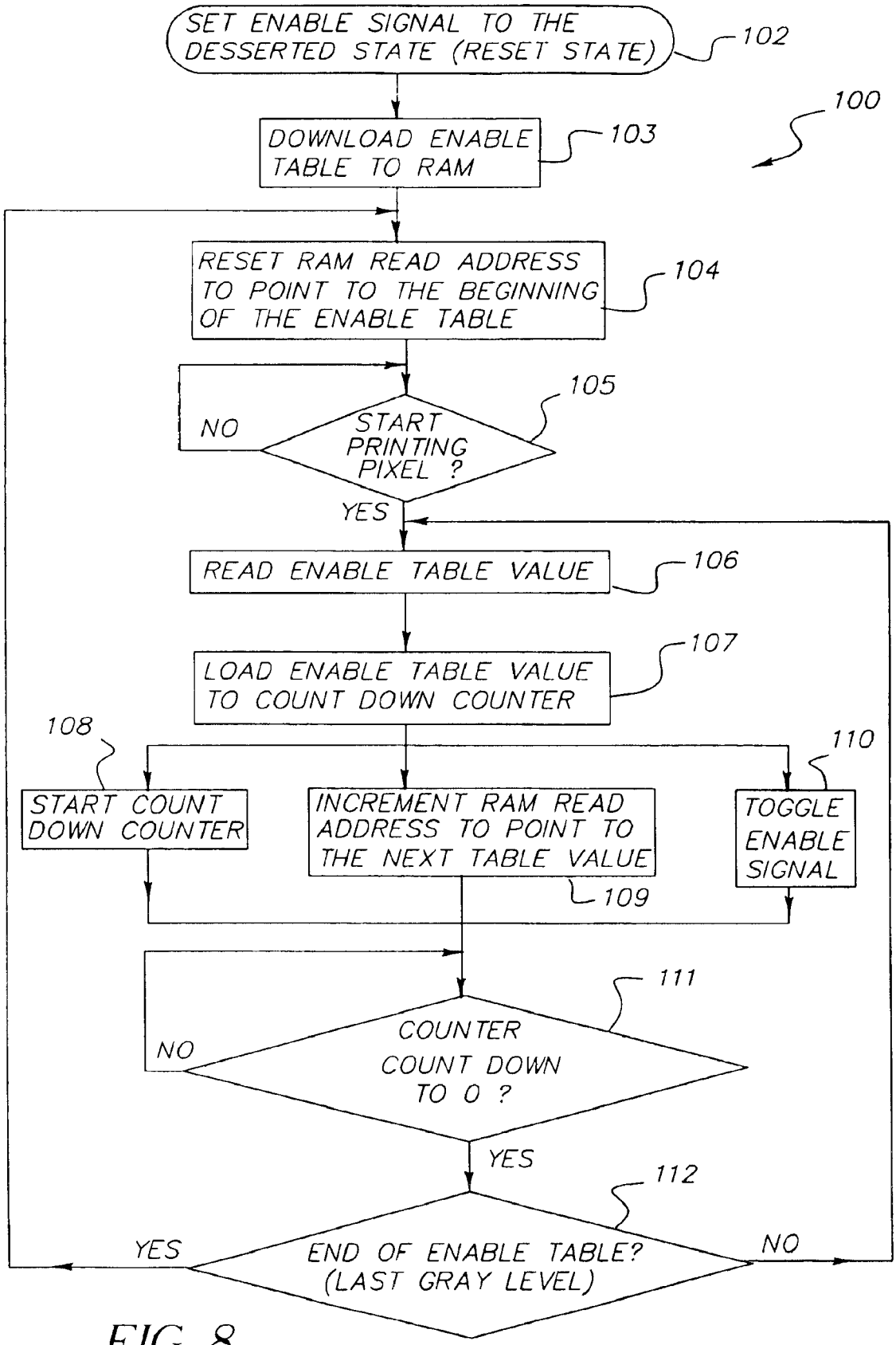
FIG. 8 is a flow diagram in accordance with one embodiment of the present invention that may be used to operate the nozzles of the print head.

The sequence of operations for the circuitry of FIG. 7 in accordance with one embodiment is shown by the flow diagram 100 of FIG. 8. Initially, the ENABLE signal is in a reset/deasserted state as shown in step 102. At initialization, the ENABLE Table which in the present example, has the values of TABLE 1, is downloaded into RAM 92 in step 103. The State Machine 98 then pulses a Read_Address_Reset signal to the RAM Read Address Generator 96 so that it initializes its outputs to point to the beginning address of the ENABLE Table as shown in step 104. When a print job is started in step 105, the State Machine 98 first asserts the RAM_Read signal to the RAM 92 which causes the RAM 92 to place the first digital value of the table onto Counter_Data thereby reading and loading the ENABLE Table value as shown in steps 106 and 107 respectively. The State Machine 98 also asserts the Counter_Load signal to the Count Down Counter 94 at this time. In addition, upon receiving the Counter_Load signal, the Count Down Counter 94 latches Counter_Data into an internal register. The value in Counter_Data is used as the starting value where the Count Down Counter 94 starts counting down in step 108. The State Machine 98 then deasserts the Counter_Load and RAM_Read signals, and asserts the ENABLE signal as its output.

Since the first digital value of the ENABLE Table of the present example having the values of TABLE 1 contains the pulse width of the first HIGH pulse width segment, the ENABLE signal provided as the output of the State Machine 98 will be asserted to a digital value of 1. As soon as the Counter_Load signal is deasserted, the Count Down Counter 94 counts down in step 108, and the State Machine 98 toggles the ENABLE signal to an opposite polarity in step 110. It should be noted here that step 110 is the first instance of toggling from the Reset state of 0 to a 1. The toggled value remains at 1 until after the Count Down Counter 94 completes step 111 and loops back to step 106 discussed above.

While the Count Down Counter 94 is counting, the State Machine 98 pulses the Read_Address_Clock so that the output of the RAM Read Address Generator 96 is incremented to point to the address of the next value in the ENABLE Table 89 to ready for the next read in step 109. When the State Machine 98 determines that the output of the Count Down Counter 94 is zero as shown in step 111, the State Machine 98 then starts loading in the next ENABLE Table value shown in TABLE 1 into the Count Down Counter 94 and the same sequence of events will be repeated until the last table value of the ENABLE Table is read and loaded into the Count Down Counter 94 as shown in step 112. Then the whole process starts again for the next pixel to be printed by the nozzle 40 of the print head 16. Of course, it should be understood that the above described method is merely one example and the present invention should not be construed to be limited thereto.

Thus, based on the discussion above, it should be evident that the present invention provides a method for generating an electrical signal such as the ENABLE signal with a plurality of pulses used to operate a continuous ink jet printer with a plurality of nozzles. As can now be appreciated, the method includes the steps of generating a data table such as the ENABLE Table described above with a plurality of segment values, each segment value designating one of a high pulse and a low pulse of the electrical signal, and designating the pulse width of the designated pulse, reading a segment value from the data table, and generating at least one of a high pulse and a low pulse, the generated pulse and pulse width of the generated pulse being designated by the read segment value.

In the embodiment specifically shown in FIGS. 6, 7, and 8 the present method further includes the step of iteratively reading each of the plurality of segment values from the data table and the step of generating at least one of a high pulse and a low pulse after each segment value is read from the data table, the generated pulse and pulse width being designated by each of the iteratively read segment values. Because each of the segment values can be customized, pulse width of two consecutive high pulses or low pulses may be different from one another as shown in the ENABLE signal of FIG. 5.

Of course, the present method also provides a significant advantage in that new segment values may be readily loaded into the ENABLE Table so that a different ENABLE signal with different high pulses and low pulses can be readily generated. This provides a cost effective method for adjusting the pulse width and/or pulse period of the signal pulses. Moreover, as also previously described, the method in the described embodiment further includes the step of using the count down counter 94 to convert pulse width designated by each of the iteratively read segment values into time while the RAM Read Address Generator 96 is used to iteratively designate which segment value is to be read.

The actual digital values stored in the ENABLE Table for each segment pulse width which correspond to those shown in TABLE 1 may be calculated using the following formula:

$$\underset{\textit{(unit of Clock Cycle)}}{\text{Digital Segment Value}} = \frac{(\text{Segment Pulse Width} - \text{Control Logic Overhead})}{\text{Count Down Counter Clock Period}}$$

where all units are in time except for the result which is in Counter Clock Cycle.

The clock frequency of the Count Down Counter 94 dictates the resolution of the ENABLE signal output by the State Machine 98. Therefore, if higher resolution is desired, a higher clock frequency is required for the Count Down Counter 94. From the above equation, the minimum segment pulse width for the operational steps shown in FIG. 8 is bounded by the Control Logic Overhead, such overhead being generally known in the control logic arts and in this example, comprising the logical loop defined by steps 112, 106, and 107, the discussion of which is omitted here. In general, the Control Logic Overhead is very small compared to the segment pulse width so it is not a significant problem. However, if the Control Logic Overhead is significant, there are various ways to reduce or eliminate the overhead, for instance, by rearrange the operations shown in FIG. 8 to the one as shown in FIG. 9.

Figure 9:
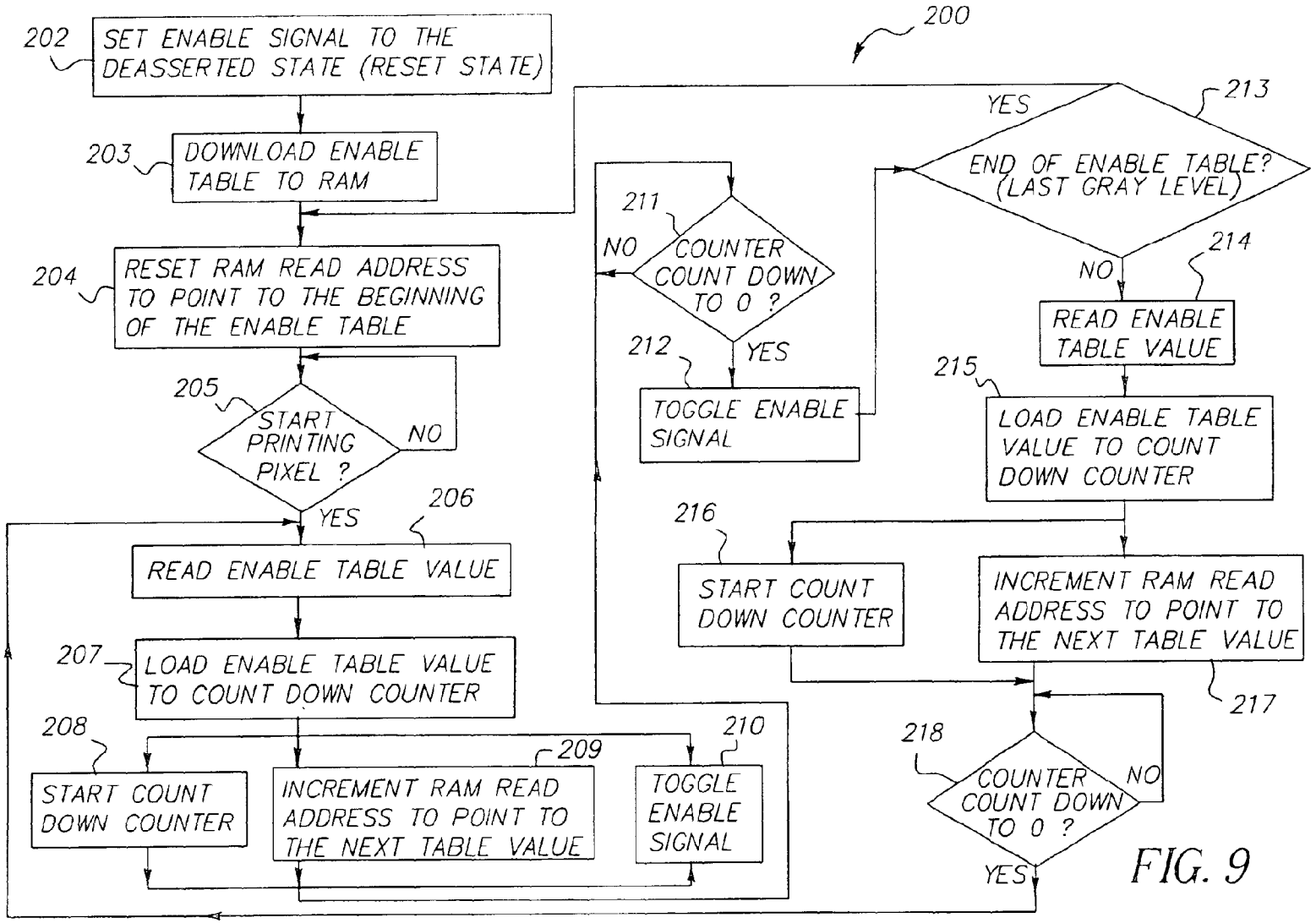
FIG. 9 is a modified embodiment of flow diagram of FIG. 8.

As can be seen, the flow diagram 200 shown in FIG. 9 is similar to that shown in FIG. 8 with respect to steps 202 to 211 which are numbered correspondingly in the two hundreds, discussion of these steps being omitted to avoid repetition. As can be seen, additional steps are provided in this embodiment to allow for all pulse segments with one polarity to have as small pulse width as one clock period of the Count Down Counter 94. Thus, all the Control Logic Overhead is shifted to the segments with the other polarity. In particular, when the State Machine 98 determines that the output of the Count Down Counter 94 is zero as shown in step 211, the ENABLE signal is toggled as shown in step 212. If the last table value of the ENABLE Table is read and loaded into the Count Down Counter 94, the same sequence is repeated as shown in step 213. Otherwise, another ENABLE Table value is read and loaded to the Count Down Counter 94 as shown in steps 214 and 215 respectively. Then, the Count Down Counter 94 is started while the RAM Read_Address is incremented to point to the next table value as shown in steps 216 and 217 respectively. If the Count Down Counter 94 has counted down to zero in step 218, the process is resumed at step 206.

Of course, the above described method is merely one example which can be used to eliminate the effect of Control Logic Overhead and the present invention is not limited thereto. Another method for eliminating the Control Logic Overhead is to add an additional Count Down Counter (not shown) so that while one counter counts the HIGH pulse width segment, the other counter counts the LOW pulse width segment, thus, eliminating the need to wait for reading and loading the next value.

In accordance with the present invention, very specific customizable pulsetrain such as the ENABLE signal, may be generated to control the continuous ink jet print head by using an ENABLE Table coupled with a counter and synchronization logic in the manner described above. One significant advantage of the invention is that it allows for dynamic ENABLE signal generation since the segment values in the ENABLE Table can be changed at any given time by downloading new segment values to the ENABLE Table.

Still another advantage is that the method in accordance with present invention can be readily used to generate delayed version of the ENABLE signal where multiple ENABLE signals is required due to the configuration of the print head, for instance, as shown in FIG. 3 where two ENABLE signals are required due to the grouping of the nozzles. The grouping of the nozzles may necessitate a second ENABLE signal which may be attained by providing a delayed signal such as an ENABLE(x+1) signal that is a fixed delayed version of the ENABLEx signal so as to avoid turning on all heaters elements of the plurality of nozzles at the same time.

Figure 10:
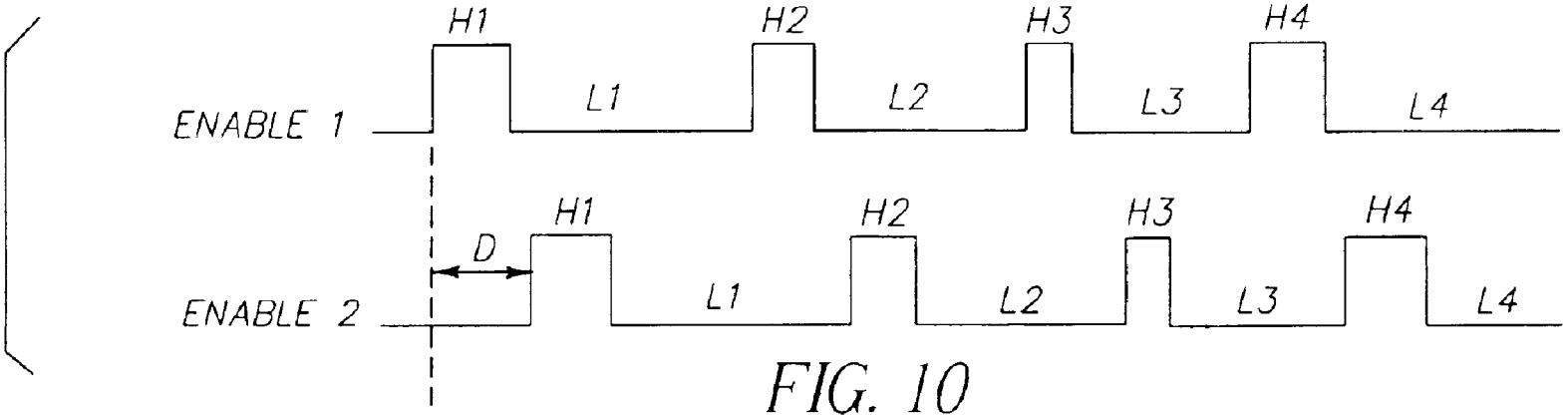
FIG. 10 is a schematic illustration of a generic ENABLE1 signal corresponding to that shown in FIG. 5 and an ENABLE2 signal which is delayed by a delay period "D".

FIG. 10 shows such an example where ENABLE2 signal is a delayed version of ENABLE1 signal, the delay being indicated by "D" that represents a LOW segment pulse width. In such an embodiment, two ENABLE Tables would be used, each corresponding to generate the illustrated ENABLE1 signal and ENABLE2 signal, respectively. In the illustrated example, the ENABLE1 Table containing the segment values of Table 1 shown previously. The segment values of the ENABLE2 Table is shown in Table 2 having pairs of Low and High pulse width segments. The delay is attained by the shown ENABLE2 Table by first designating the generation of a low pulse which delays the generation of a first high pulse. Again, the actual segment values would be numerically represented instead of the descriptors which are shown below for clarity.

TABLE 2

| |
|---|
| LOW segment pulse width (delay) = D |
| HIGH segment pulse width 1 = H1 |
| LOW segment pulse width 1 = L1 |
| HIGH segment pulse width 2 = H2 |
| LOW segment pulse width 2 = L2 |
| HIGH segment pulse width 3 = H3 |
| LOW segment pulse width 3 = L3 |
| . |
| . |
| . |
| HIGH segment pulse width L |

As can be appreciated from reviewing TABLE 2 together with FIG. 10, the ENABLE(x+1) signal is identical to the ENABLEx signal from which it is derived except that it is delayed. No other variation in pulse width and/or pulse period is possible by mere delay of an ENABLE signal pulse train.

Figure 11:
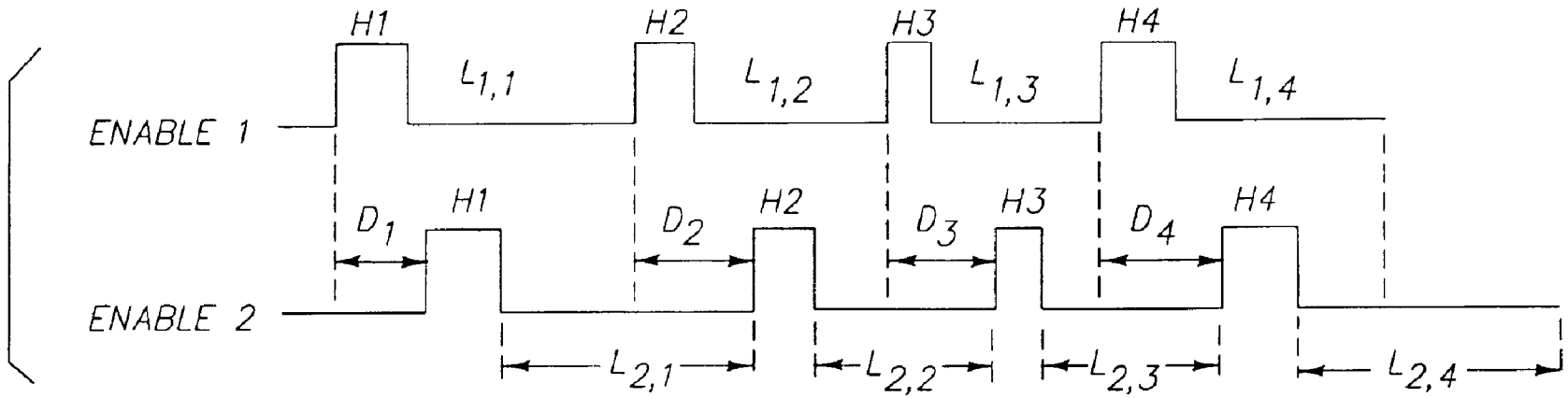
FIG. 11 is a schematic illustration of a generic ENABLE1 signal corresponding to that shown in FIG. 5 and an ENABLE2 signal, each pulse of the ENABLE2 signal being delayed by a specific delay period.

However, as described previously above, the method in accordance with the present invention goes a step further in that the method allows variation in pulse width and/or pulse period so that a delay may be programmed between each of the ENABLE signals. In this regard, the delay between the two ENABLE signals can be different for each graytone level in an G graytone level printing system as shown in FIG. 11. In the manner described above relative to FIG. 10, two ENABLE signals are shown in FIG. 11, ENABLE1 signal having segment values tabulated in TABLE 3 below and ENABLE2 signal having segment values tabulated in TABLE 4 below.

As can be seen by comparing the two ENABLE signals in FIG. 11, it should be clear that not only a delay incorporated in the pulse train of ENABLE2 signal, each of the pulses have a unique delay associated thereto. The variations in the delay is clearly indicated by the different subscript suffixes assigned to each of the delay "D" shown. Moreover, as a result of the variations in each of the pulses of the pulsetrain, the LOW segment pulse width is also varied accordingly. Thus, this invention provides a very flexible way of positioning the pulses of the ENABLE signal pulsetrain in a multiple ENABLE signal print head and allows variation in pulse width and/or pulse period. As noted previously, the actual segment values would be numerically represented instead of the descriptors which are shown below for clarity.

TABLE 3

| ENABLE 1 |
|---|
| HIGH segment pulse width 1 = H1 |
| LOW segment pulse width 1 = $L_{1,1}$ |
| HIGH segment pulse width 2 = H2 |
| LOW segment pulse width 2 = $L_{1,2}$ |
| HIGH segment pulse width 3 = H3 |
| LOW segment pulse width 3 = $L_{1,3}$ |
| . |
| . |
| . |
| HIGH segment pulse width L = HL |
| LOW segment pulse width L = $L_{1,L}$ |

TABLE 4

| ENABLE 2 |
|---|
| LOW segment pulse width = D1 |
| HIGH segment pulse width 1 = H1 |
| LOW segment pulse width 1 = $L_{2,1}$ |
| HIGH segment pulse width 2 = H2 |
| LOW segment pulse width 2 = $L_{2,2}$ |
| HIGH segment pulse width 3 = H3 |
| . |
| . |
| . |
| LOW segment pulse width (L-1) = $L_{2,L-1}$ |
| HIGH segment pulse width L = HL |

As can be seen from the above tables and FIG. 11, two segment values of the data table that designate two consecutive high or low pulses designate pulses have different pulse widths from one another. Correspondingly, the low pulses may be used to delay the generation of the high pulses. Therefore, in view of the above teachings, it should now be evident how the present invention provides a simple method for generating the ENABLE signal having a variable pulse width and/or variable pulse period waveform for use in controlling the heaters of an inkjet print head. It should also be apparent that by utilizing an ENABLE Table with segment values, the present invention allows simple modification of the generated pulsetrain.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

Parts List

1 continuous ink jet printer system
10 image source
12 image processing unit
14 heater control circuit
16 print head
17 ink gutter
18 recording medium
19 ink recycling unit
20 recording medium transport system
22 recording medium transport control system
24 micro-controller
26 ink pressure regulator
28 ink reservoir
30 ink channel device
40 nozzle
42 substrate
46 nozzle bore
50 heater
51*a* first heater element
51*b* second heater element
54 power source
55 ground
56*a* driver transistor
56*b* driver transistor
58*a* AND gate
58*b* AND gate
60*a* shift register
70*a* latch registers
80 pulsetrain
86 memory
87 counter
88 synchronization logic
89 ENABLE Table
92 random access memory (RAM)
94 count down counter
96 RAM read address generator
98 state machine
100 flow diagram
102 step
103 step
104 step
105 step
106 step
107 step
108 step
109 step
110 step
111 step
112 step
200 flow diagram
202 step
203 step
204 step
205 step
206 step
207 step
208 step
209 step
210 step
211 step
212 step
213 step
214 step
215 step
216 step
217 step
218 step

What is claimed is:

1. A method for generating an electrical signal with a plurality of pulses comprising the steps of:

generating a data table with a plurality of segment values, each segment value designating one of a high pulse and a low pulse of the electrical signal, the designated pulse having a pulse width;

reading a segment value from the data table;

generating at least one of a high pulse and a low pulse, the generated pulse and pulse width of the generated pulse being designated by the read segment value, the generated pulse having a pulse width; and iteratively reading each of a plurality of segment values from the data table, wherein the pulse width of the generated pulse varies depending on the pulse width of the designated pulse.

2. The method of claim 1, further including the step of generating at least one of a high pulse and a low pulse after each segment value is read from the data table, the generated pulse and pulse width being designated by each of the iteratively read segment values.

3. The method of claim 2, wherein pulse width of two consecutive high pulses are different from one another.

4. The method of claim 2, wherein pulse width of two consecutive low pulses are different from one another.

5. The method of claim 2, further including the step of loading a new plurality of segment values into the data table after the plurality of segment values are iteratively read from the data table.

6. The method of claim 2, further including the step of converting the pulse width designated by each of the iteratively read segment values into time.

7. The method of claim 2, further including the step of iteratively designating which segment value is to be read.

8. The method of claim 1, wherein the first segment value in the data table designates a high pulse.

9. The method of claim 1, wherein the first segment value in the data table designates a low pulse.

10. The method claim 9, wherein the low pulse designated by the first segment value in the data table delays the generation of a first high pulse.

11. A method for generating an electrical signal with a plurality of pulses used to operate a printer comprising the steps of:

generating a data table with a plurality of segment values, each segment value designating one of a high pulse and a low pulse of the electrical signal, and designating the pulse width of the designated pulse;

reading a segment value from the data table;

generating at least one of a high pulse and a low pulse, the generated pulse and pulse width of the generated pulse being designated by the read segment value, wherein the plurality of segment values in the data table designate the high pulse and low pulse in alternating order; and iteratively reading each of the plurality of segment values from the data table.

12. The method of claim 11, wherein two segment values of the data table that designate two consecutive high pulses designate high pulses having different pulse widths from one another.

13. The method of claim 11, wherein two segment values of the data table that designate two consecutive low pulses designate low pulses having different pulse widths from one another.

14. The method of claim 13, wherein the low pulses delay the generation of the high pulses.

15. A method for generating an electrical signal with a plurality of pulses used to operate a printer comprising the steps of:

generating a data table with a plurality of segment values, each segment value designating one of a high pulse and a low pulse of the electrical signal, and designating the pulse width of the designated pulse;

reading a segment value from the data table;

generating at least one of a high pulse and a low pulse, the generated pulse and pulse width of the generated pulse being designated by the read segment value; and iteratively reading each of the plurality of segment values from the data table.

16. A control circuit for generating an electrical signal with a plurality of pulses used to operate a printer comprising:

a memory device adapted to store a data table with a plurality of segment values, each segment value designating one of a high pulse and a low pulse of the electrical signal, and designating the pulse width of the designated pulse;

a counter for sequentially counting based on a segment value from the data table to thereby convert the pulse width designated by the segment value into time; and a synchronization device adapted to synchronize the memory device with the counter to allow loading of each of the plurality of segment values from the memory device to the counter, wherein the counter provides a counter output to the synchronization logic and the synchronization logic outputs the electrical signal based on the counter output.

17. The control circuit of claim 16, wherein the synchronization logic includes a state machine.

18. The control circuit of claim 16, further including a read address generator that iteratively designates which segment value from the memory device is loaded to the counter by the synchronization device.

19. The control circuit of claim 16, wherein the memory device is random access memory.

20. The control circuit of claim 16, wherein the counter is a count down counter.

21. The control circuit of claim 16, wherein the counter is a count up counter.

22. A method for generating an electrical signal with a plurality of pulses used to operate a printer comprising the steps of:

generating a data table with a plurality of segment values, each segment value designating one of a high pulse and a low pulse of the electrical signal, and designating the pulse width of the designated pulse;

reading a segment value from the data table;

generating at least one of a high pulse and a low pulse, the generated pulse and pulse width of the generated pulse being designated by the read segment value, wherein the first segment value in the data table designates a high pulse; and iteratively reading each of the plurality of segment values from the data table.

23. A method for generating an electrical signal with a plurality of pulses used to operate a printer comprising the steps of:

generating a data table with a plurality of segment values, each segment value designating one of a high pulse and a low pulse of the electrical signal, and designating the pulse width of the designated pulse;

reading a segment value from the data table;

generating at least one of a high pulse and a low pulse, the generated pulse and pulse width of the generated pulse being designated by the read segment value, wherein the first segment value in the data table designates a low pulse, the low pulse delaying the generation of a first high pulse; and iteratively reading each of the plurality of segment values from the data table.

24. A method for generating an electrical signal with a plurality of pulses used to operate a printer comprising the steps of;

generating a data table with a plurality of segment values, the segment values having no image data, each segment value designating one of a high pulse and a low pulse of the electrical signal, and designating the pulse width of the designated pulse;

reading a segment value from the data table;

generating at least one of a high pulse and a low pulse, the generated pulse and pulse width of the generated pulse being designated by the read segment values; and iteratively reading each of the plurality of segment values from the data table.

25. The method of claim 24, wherein the plurality of segment values in the data table designate the high pulse and low pulse in alternating order.

26. The method of claim 25, wherein two segment values of the data table that designate two consecutive high pulses designate high pulses having different pulse widths from one another.

27. The method of claim 25, wherein two segment values of the data table that designate two consecutive low pulses designate low pulses having different pulse widths from one another.

28. The method of claim 27, wherein the low pulses delay the generation of the high pulses.

29. The method of claim 24, wherein the first segment value in the data table designates a high pulse.

30. The method of claim 24, wherein the first segment value in the data table designates a low pulse.

31. The method of claim 30, wherein the low pulse designated by the first segment value in the data table delays the generation of a first high pulse.

* * * * *